US010287128B2

(12) United States Patent
Gallegos

(10) Patent No.: US 10,287,128 B2
(45) **Date of Patent: *May 14, 2019**

(54) TAPE DISPENSER

(71) Applicant: Robert Joseph Gallegos, Fremont, CA (US)

(72) Inventor: Robert Joseph Gallegos, Fremont, CA (US)

(73) Assignee: Joe Gallegos Design LLC, Fremont, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/638,414

(22) Filed: Jun. 30, 2017

(65) Prior Publication Data

US 2017/0297853 A1 Oct. 19, 2017

Related U.S. Application Data

(63) Continuation-in-part of application No. 14/788,204, filed on Jun. 30, 2015, now Pat. No. 9,725,273.
(Continued)

(51) Int. Cl.
*B65H 35/00* (2006.01)
*B26D 5/20* (2006.01)
(Continued)

(52) U.S. Cl.
CPC ..... *B65H 35/0026* (2013.01); *B26D 5/20* (2013.01); *B26D 7/00* (2013.01); *B65H 35/0033* (2013.01);
(Continued)

(58) Field of Classification Search
CPC ..... Y10T 225/20; Y10T 225/238; Y10T 225/241; Y10T 225/245; Y10T 225/247;
(Continued)

(56) References Cited

U.S. PATENT DOCUMENTS 4,762,586 A * 8/1988 Wilkie ..... B65H 35/0033 156/527
6,152,398 A * 11/2000 Chen ..... B65H 35/0026 156/527
(Continued)

FOREIGN PATENT DOCUMENTS

DE 202016102574 U1 * 6/2016 ..... B65H 35/0033
FR 2710331 A3 * 3/1995 ..... B65H 35/0033
JP WO 2004101411 A1 * 11/2004 ..... B65H 35/0033

*Primary Examiner* — Jennifer B Swinney
(74) *Attorney, Agent, or Firm* — White-Welker & Welker, LLC; Matthew T. Welker, Esq.

(57) ABSTRACT

A tape dispenser with a handle providing an optimized grip handle in a parallel axis with the tape spool axis. A burnisher and tape end guide serves as a guard that covers the sharp teeth of the device when in the closed position. As the burnisher and tape end guide is held in the closed position it provides a support surface. This position allows space between the resting surface and the roller which, in combination with the tape end catch and the contact surface of the main body ensures that the adhesive tape does not stick to the resting surface. The tape end catch works in combination with the burnisher and tape end guide, return spring, tape end guide, and formed-in axis, counter-bored hole to capture the loose end of the tape once the blade cuts through the width of the tape.

18 Claims, 23 Drawing Sheets

Related U.S. Application Data

(60) Provisional application No. 62/019,904, filed on Jul. 2, 2014.

(51) Int. Cl.
*B26D 7/00* (2006.01)
*B26D 7/18* (2006.01)
*B26D 5/00* (2006.01)

(52) U.S. Cl.
CPC ..... *B26D 5/00* (2013.01); *B26D 7/1827* (2013.01); *B65H 35/00* (2013.01); *Y10T 225/20* (2015.04); *Y10T 225/245* (2015.04); *Y10T 225/257* (2015.04); *Y10T 225/282* (2015.04)

(58) Field of Classification Search
CPC ..... Y10T 225/257; Y10T 225/261; Y10T 225/263; Y10T 225/282; B65H 35/002; B65H 35/0026; B65H 35/0033; B65H 35/0046
See application file for complete search history.

(56) References Cited

U.S. PATENT DOCUMENTS

2004/0007172 A1* 1/2004 Sakoff ..... B65H 35/0033 118/52
2004/0099380 A1* 5/2004 Ho ..... B65H 35/0033 156/577
2007/0246153 A1* 10/2007 Schurman ..... B29C 63/10 156/185
2008/0099151 A1* 5/2008 Lee ..... B65H 35/0033 156/527

* cited by examiner

TAPE DISPENSER

CROSS REFERENCE TO RELATED APPLICATIONS

This application claims priority from and is a continuation of U.S. patent application Ser. No. 14/788,204, entitled "Tape Dispenser", filed on 30 Jun. 2015. The benefit under 35 USC § 120 and § 119(e) of the United States patent application is hereby claimed, and the aforementioned application is hereby incorporated herein by reference.

U.S. patent application Ser. No. 14/788,204, entitled "Tape Dispenser", filed on 30 Jun. 2015 claims priority from U.S. Provisional Patent Application Ser. 62/019,904, entitled "Combination Tape Dispenser", filed on 2 Jul. 2014. The benefit under 35 USC § 120 and § 119(e) of the United States provisional patent application is hereby claimed, and the aforementioned application is hereby incorporated herein by reference.

FEDERALLY SPONSORED RESEARCH

Not Applicable

SEQUENCE LISTING OR PROGRAM

Not Applicable

TECHNICAL FIELD OF THE INVENTION

The present invention relates generally to tape dispensers. More specifically, the present invention relates to tape dispensers with ergonomic handles.

BACKGROUND OF THE INVENTION

Tape dispensers currently found in the market all employ pistol grip handles which result in severe hand, wrist, and forearm strain in combination with the resultant awkwardly applied forces from poorly located centers of gravity between the tape spool and the handle. Also, other similar products do not provide additional means for dispensing lengths of tape without the need for additional bracket or hardware.

Other devices exclusively use a pistol grip handle that is oriented on a perpendicular axis to the tape roll. Due to their design, these pistol grips are also oriented in a location that is an excessively long moment arm distance from the other two functional components: the tape roll and the cut-off device, which maximizes manual strain and fatigue during use. The weight distribution among all three components (tape roll, pistol grip, and cut-off mechanism) are less than optimum which results in excessive wrist and forearm fatigue and strain.

The pistol grip limits the amount of angular range that a user can apply while applying tape to a box from multiple sides, angles and directions. The orientation of the pistol grip to the cut-off device frequently requires the user to hyper-extend the wrist, arm and shoulder in order to cut off the tape.

The shape, location and poor weight distribution of the pistol grip does not allow for fingertip articulation limiting the ability to apply quick, subtle and varying force and motion while negotiating a tape application stroke at changing angles throughout. Therefore, what is needed is a new tape dispenser with a better handle design that eliminates all the shortcomings of the commonly used pistol grip.

SUMMARY OF THE INVENTION

The present invention seeks to provide a solution to the pistol grip problems by providing an ellipsoid shaped handle placed in a parallel axis with the tape spool axis.

The ellipsoid shaped handle of the present invention provides an optimized grip angle orientation for directly dispensing packaging tape onto common containment items such as, but not limited to, cardboard boxes. The ellipsoid shaped handle of the present invention provides greater freedom of angular movement, articulation, and force application while providing improved weigh distribution of the working components (handle, tape spool, and cut off device).

The specific component placement that defines a base structure for the dispenser to sit solidly on top of a flat, horizontal surface providing a secondary means to manually dispense lengths of tape.

A burnisher and tape end guide replaces the Burnisher of the original disclosure. The added functionality provides several improvements over the original component. The burnisher and tape end guide serves as a guard that covers the sharp teeth of the device when in the closed position.

The burnisher and tape end guide is maintained in the closed position by the combination of feature working together to contain the part between the main body and the roller plate. Additionally, there is a torsion spring shown as return spring, tape end guide which is installed around a recessed shown as spring recess as part of the burnisher and tape end guide. The legs of the return spring, tape end guide are oriented between the spring recess and the main body such that there is ample pre-load on the spring in the closed position to ensure that the burnisher and tape end guide is held firmly in the closed position.

As the burnisher and tape end guide is held in the closed position it provides a support surface. This position allows space between the resting surface and the roller which, in combination with the tape end catch and the contact surface of the main body ensures that the adhesive tape does not stick to the resting surface.

The burnisher and tape end guide rotates around the formed-in axis and counter-bored hole which allows the burnisher and tape end guide to be in the optimum position to perform a burnishing motion against the tape in the correct position for the blade to cut through the width of the tape. The burnishing operation ensures that the tape end which is applied to the workpiece is adhered with compression force as recommended by tape manufacturers.

The tape end catch works in combination with the burnisher and tape end guide, return spring, tape end guide, and formed-in axis, counter-bored hole to capture the loose end of the tape once the blade cuts through the width of the tape.

Therefore the present invention reduces manual strain due to improved placement of grip, distribution of centers of gravity, orientation of grip in relation to the cut-off device. Also, the present invention greatly reduces the common condition of the loose tape end from sticking to various parts of the tape dispenser and its components, or sticking to nearby objects.

BRIEF DESCRIPTION OF THE DRAWINGS

The accompanying drawings, which are incorporated herein and form a part of the specification, illustrate the present invention and, together with the description, further serve to explain the principles of the invention and to enable a person skilled in the pertinent art to make and use the invention.

DETAILED DESCRIPTION OF THE INVENTION

Figure 1:
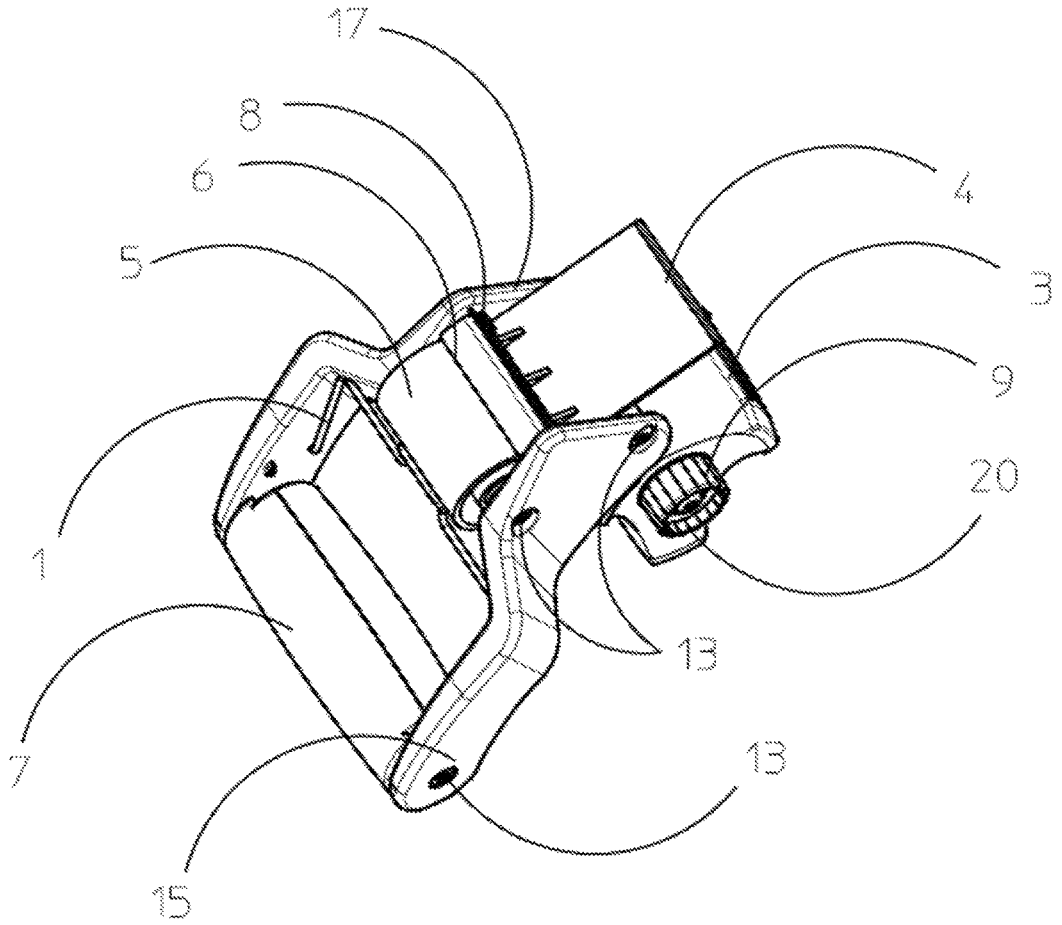
FIG. 1 is an Isometric top view of the device of the present invention.
Figure 2:
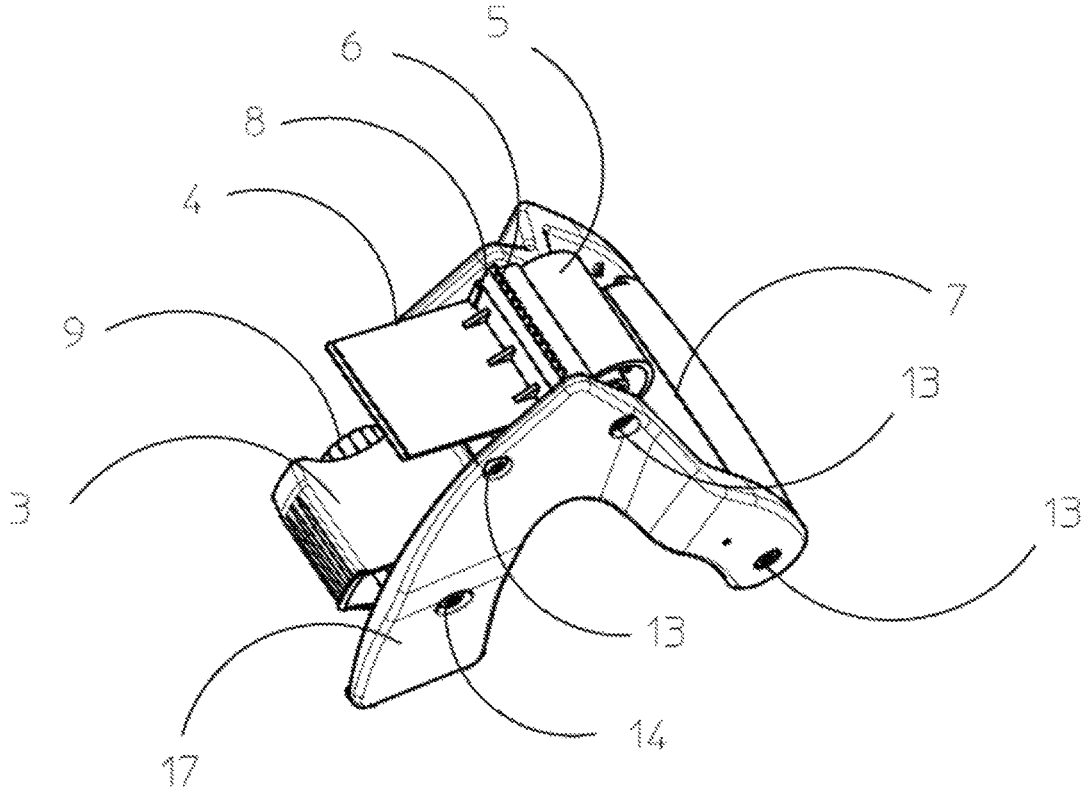
FIG. 2 is an Isometric top opposing side view of the device of the present invention.
Figure 3:
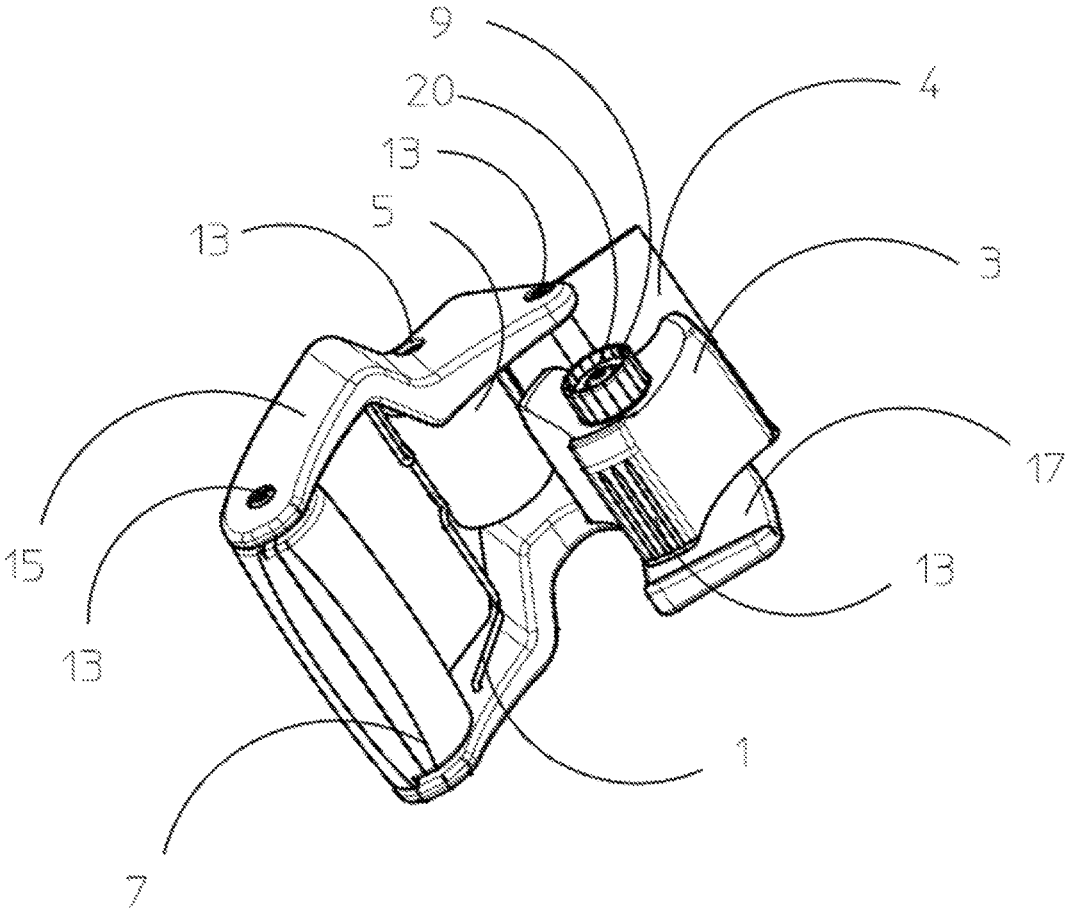
FIG. 3 is an Isometric bottom view of the device of the present invention.
Figure 4:
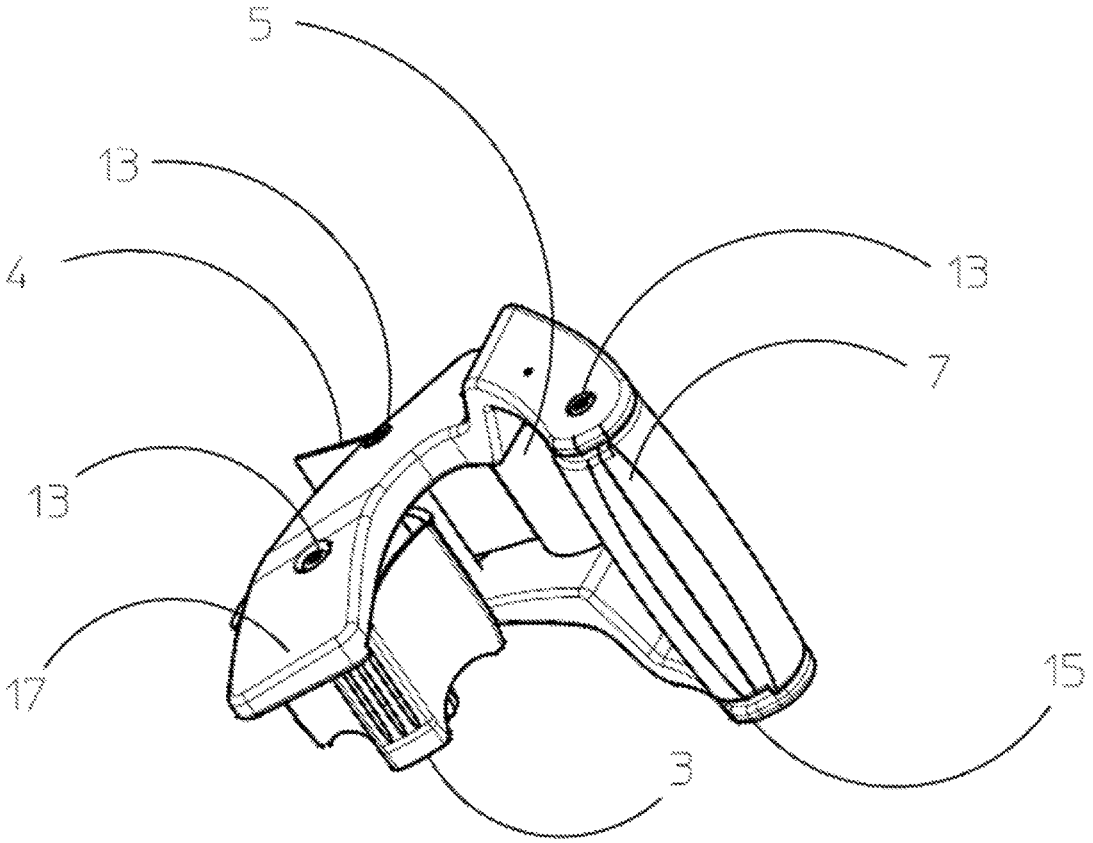
FIG. 4 is an Isometric bottom opposing side view of the device of the present invention.
Figure 5:
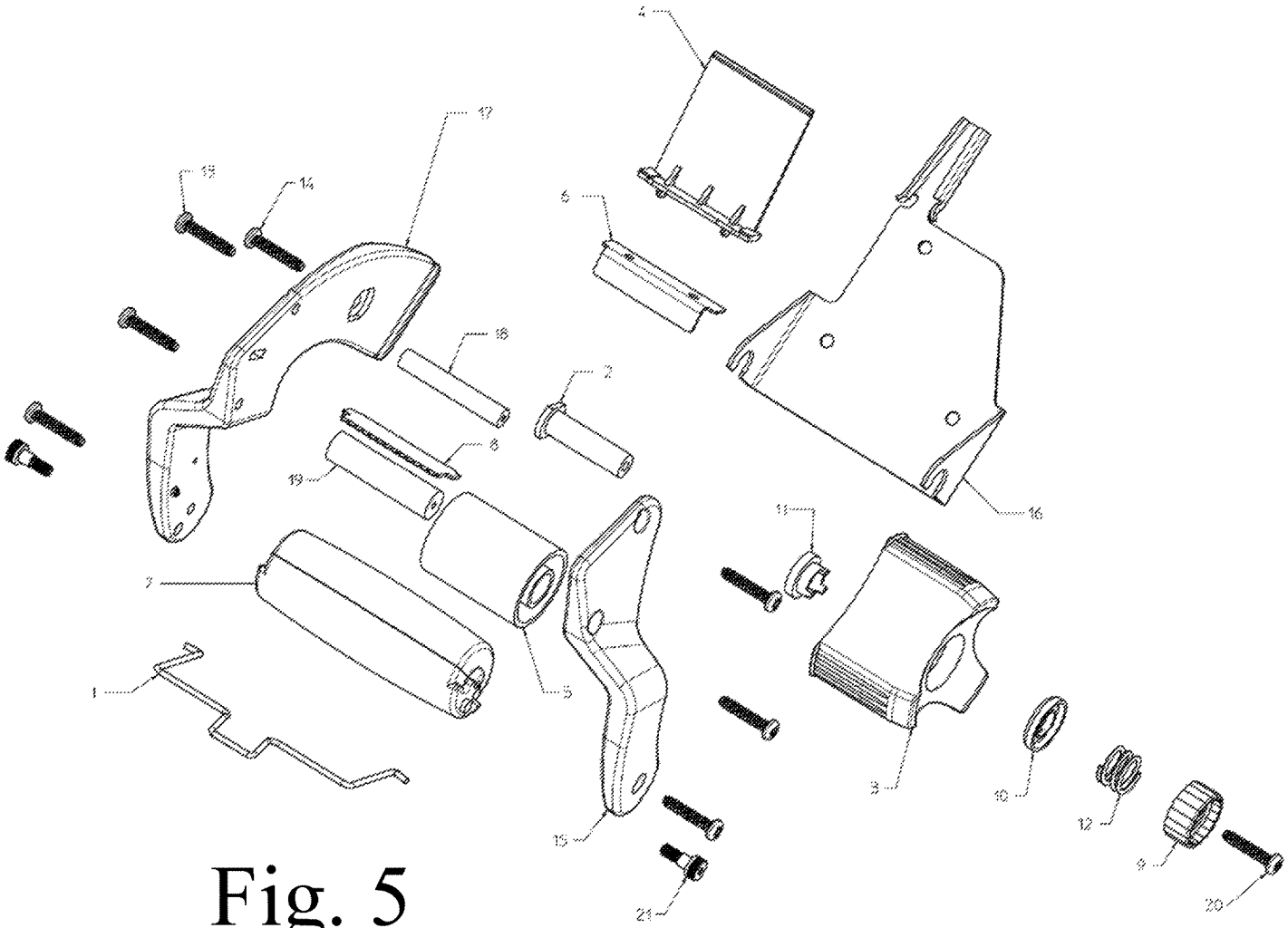
FIG. 5 is an expanded view of the device of the present invention illustrating the component parts of the invention and their relationship in combination to each other.

In the following detailed description of the invention of exemplary embodiments of the invention, reference is made to the accompanying drawings (where like numbers represent like elements), which form a part hereof, and in which is shown by way of illustration specific exemplary embodiments in which the invention may be practiced. These embodiments are described in sufficient detail to enable those skilled in the art to practice the invention, but other embodiments may be utilized and logical, mechanical, electrical, and other changes may be made without departing from the scope of the present invention. The following detailed description is, therefore, not to be taken in a limiting sense, and the scope of the present invention is defined only by the appended claims.

In the following description, numerous specific details are set forth to provide a thorough understanding of the invention. However, it is understood that the invention may be practiced without these specific details. In other instances, well-known structures and techniques known to one of ordinary skill in the art have not been shown in detail in order not to obscure the invention.

The present invention seeks to provide a solution to the pistol grip problems by providing an ellipsoid shaped handle 7 placed in a parallel axis with the tape spool axis. The ellipsoid shaped handle 7 of the present invention provides an optimized grip angle orientation for directly dispensing packaging tape onto common containment items such as, but not limited to, cardboard boxes. The ellipsoid shaped handle 7 of the present invention provides greater freedom of angular movement, articulation, and force application while providing improved weigh distribution of the working components (handle, tape spool, and cut off device).

Referring to the figures, it is possible to see the various major elements constituting the apparatus of the present invention. Now referring to the Figures, one embodiment of the tape dispenser is illustrated. The tape dispenser is comprised of: main body 17 and arm 15, which are attached to a plurality of interior components removeably affixed between them by a plurality of self-tapping screws 13 and machine screws 14. The interior components are a stem 2, small support 18, large support 19, blade, roller 5, cushion handle, platen 6, burnisher 4, and tape end guide 1.

In an alternative embodiment, the main body 17, small support 18 and large support 19 may be molded into one part during the manufacturing process. Additionally, in a fixed handle 7 embodiment, the handle 7 may also be molded in combination with the main body 17, small support 18 and large support 19 as one part. This manufacturing process and alternative embodiments may be used to minimize the parts count of the device to reduce manufacturing and assembly costs and complexities.

Figure 13:
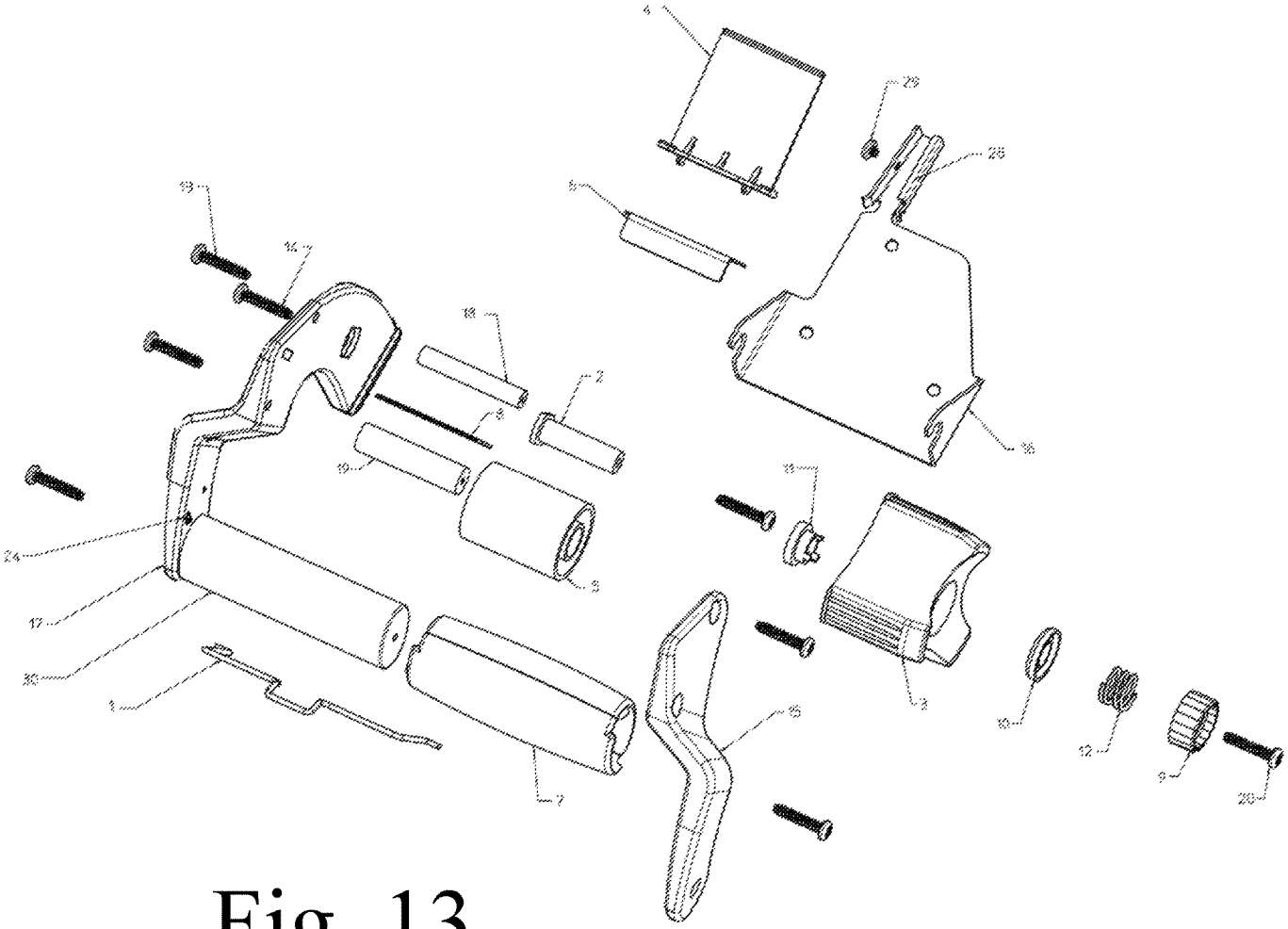
FIG. 13 is an expanded view of the device of the present invention illustrating the component parts of the invention and their relationship in combination to each other where a sleeve is used to provide rotation to the handle.

Additionally, a cushioned sleeve 7 may be slid over a fixed, molded in handle 30, providing rotation of the handle, in yet another embodiment of the present invention as shown in FIG. 13.

The materials that the present invention could be made of should include, but are not limited to plastic and metal. For instance, the main body and side arm could be stamped and formed from sheet metal. Or, if they are made from plastic, the small support 18, large support 19, and handle 7 could be formed out of or as one item from the main body 17 as previously discussed.

The present invention optimizes the weight distribution, orientation, and angular relationships of the three main components the spool which retains a tape roll, the grip, and the cut-off mechanism to improve on all four elements. The present invention results in reduced wrist and forearm fatigue and strain by optimizing the center of gravity of these components and at the same time minimizing moment arm dynamics.

The present invention provides a greater angular range on multiple sides, angles, and directions of a box by orienting the grip which allows rotational articulation of the wrist which is greater than the lateral articulation as other products are limited to. The present invention thereby eliminates hyper-extension of wrist, arm, and shoulder during cut-off operation by placing the grip and the cut-off device in an acute angular relationship rather than an obtuse angle like the other products.

The present invention also incorporates maximum finger articulation of the grip due to the improved balance of the product combined with the ellipsoidal shape of the grip allowing for increased leverage and quick angle changes with minimally applied forces, wrist and finger movements. The cushioned ellipsoid shaped handle 7 is placed in a parallel axis 23 with the tape spool axis 22, making all the above advantages possible.

Each of the interior parts is retained by either self-tapping screws 13 or machine screws 14 except the tape end guide 1, which is retained by tension forces between the main body 17 and arm 15 when the device is assembled. When assembled, corresponding holes or slots 21 are located on the main body 17 and arm 15 which retain the ends 54 of the tape end guide 1 between them using tension forces.

The main body 17 and arm 15 are secured to each other by the interior components when the interior components are attached to the main body 17 and arm 15 using self-tapping screws 13 and machine screws 14 to removable attach them on their opposing ends. The cushioned ellipsoid shaped handle 7 is attached to the main body 17 and arm 15 by machine screws 14. The roller 5 fits over a large support 19. Machine screws 14 are used to secure each end of the large support to the main body 17 and arm 15. A screw is used to retain the tension knob to the main body 17.

A platen 6 and burnisher 4 are retained between the main body 17 and arm 15. The platen 6 and burnisher 4 are retained in corresponding notches located on the interior surfaces of the main body 17 and arm 15 where compression forces hold them in place when the device is assembled. The burnisher 4 provides direction and pressure to tape as it is dispensed from the device. The pressure from the burnisher 4 applied to the dispensed tape assists in adhesion of the tape to the surface on which it is applied. The platen 6, ensure the tape leaving the spool remains flat and smooth as it passes between the blade 8 and platen 6. When a user has dispensed enough tape and desire to end dispensing, the platen 6 provides an opposing surface for holding the tape in place as the device is rotate to enable the blade to contact the tape and cut it between the blade 8 surface and platen 6.

The ellipsoid shaped handle placed in a parallel axis with the tape spool axis makes all the above possible in a plurality of embodiments. A first handle embodiment comprises a fixed handle 7 supported by the arm 15 and main body 17. The handle is either round in shape or obround (ellipsoid) a plurality of shapes to optimize the grip force as well as the ability to manipulate the handle with either the palm grasping the handle and fingers wrapped around the opposite side, or grasping with the thumb and opposing fingers in a variety of positions, angles, and forces such as to allow the maximum number of force and angle combinations. These combinations allow the user to glide the tape dispenser over the work piece such as a cardboard box, in many directions and angles that reduce the amount of wrist motion, pushing force, and repositioning of the work piece as an example of the ergonomic benefits of the present invention.

Another embodiment comprises a rotating handle supported between the arm 15 and main body 17. In a rotating embodiment, the handle is still also either round in shape or obround (ellipsoid) a plurality of shapes to optimize the grip force as well as the ability to manipulate the handle with either the palm grasping the handle and fingers wrapped around the opposite side, or grasping with the fingers and opposing thumb in a variety of positions, angles, and forces such as to allow the maximum number of force and angle combinations.

In the rotating embodiment, the handle is affixed in a way that allows it to rotate around its own axis at a full 360 degrees of rotation, or any increment thereof. The fixing means comprises a shoulder screw at each end of the handle, coaxial to the handle and captured by the arm and main body in a way that allows the handle to freely rotate within the arm and main body. It is fixed to the assembly by the means of being captured between the arm and main body, and constrained by the shoulder of the shoulder screw as it is positioned in matching counter-bored holes on the arm 15 and main body 17.

These embodiments and variations thereof obvious to someone skilled in the art could also comprise a means to limit the rotation of the handle within the assembly. One means of such is to include a semicircular race, coaxial to the hole for the shoulder screw such as to allow a dowel pin or formed-in-pin contained on the handle. This feature could be present at one or the other, or both ends of the handle arm and handle main body interface. The angle of the arc determines the limits of rotation of the handle within the assembly.

A blade 8 is retained by tension forces between the main body 17 and arm 15. Both the main body 17 and arm 15 are comprised of relief notches 22 that use compression forces to retain the blade 8 when the device is assembled. The notches 22 are rectangular in nature so as to secure the blade 8 in a fixed position with respect to the tape as it is dispensed from a roll on the spool 3 between the platen 6 and roller 5.

A small support 18 is secured to the main body 17 and arm 15 using self-tapping screws 13 and provide rigidity to the device when assembled. A stem 2 is secured to the main body 17 using a machine screw 14. The stem 2, is further comprised of a castellated washer used to support and center a spool 3 over the long axis of the stem. On an opposing end of the spool from the castellated washer 11, the spool 3 engages a washer 10, spring 12, and a tension knob 9 which are retained to the spool by a screw 20.

The tension knob 9 may be turned to adjust the amount of tension or pressure placed on the spool. This in turn adjust the rate and effort needed to dispense tape from the roll when the device is moved or placed into motion when used to dispense tape.

Finally, a platen 6 and burnisher 4 are retained between the main body 17 and arm 15. The platen 6 and burnisher 4 are retained in corresponding notches located on the interior surfaces of the main body 17 and arm 15 where compression forces hold them in place when the device is assembled. The burnisher 4 provides direction and pressure to tape as it is dispensed from the device. The pressure from the burnisher 4 applied to the dispensed tape assists in adhesion of the tape to the surface on which it is applied. The platen 6, ensure the tape leaving the spool remains flat and smooth as it passes between the blade 8 and platen 6. When a user has dispensed enough tape and desire to end dispensing, the platen 6 provides an opposing surface for holding the tape in place as the device is rotate to enable the blade to contact the tape and cut it between the blade 8 surface and platen 6.

Figure 9:
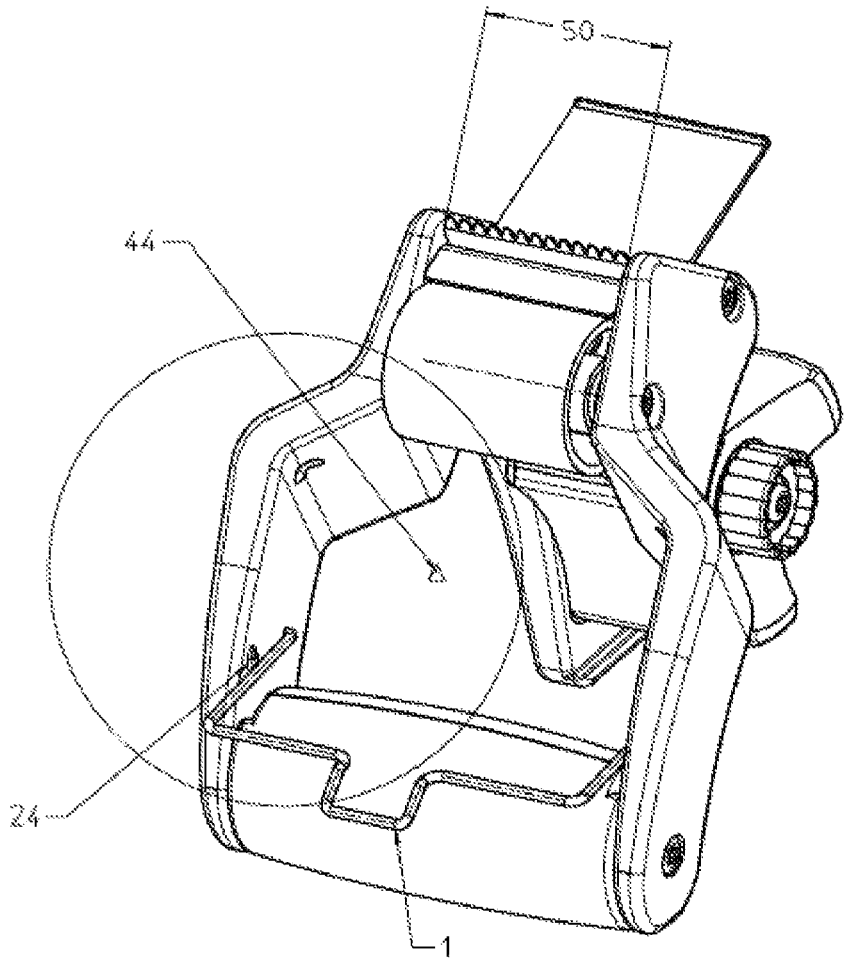
FIG. 9 illustrates a perspective view of the tape gun with the tape end guide in an open position.

A tape guide detent feature 24 is designed to guide the tape as it travels from the roll, and between the roller and itself as shown in FIGS. 9-10. Other tape guns use a sheet metal tab that rotates slightly which allows for the tape to be threaded through the gap between itself and the roller. Other tape guns have ready access from the side of the roller/guide gap, however, due to the addition of the D-shape of the horizontal handle, the analogous gap does not exist.

Figure 10A:
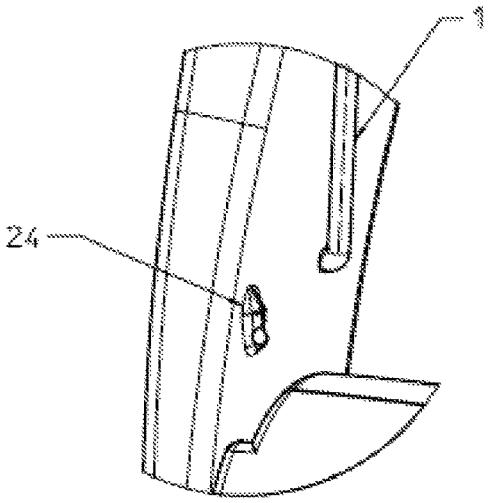
FIG. 10*a* illustrates a close up view of the tape gun with the tape end guide in a closed position.
Figure 10B:
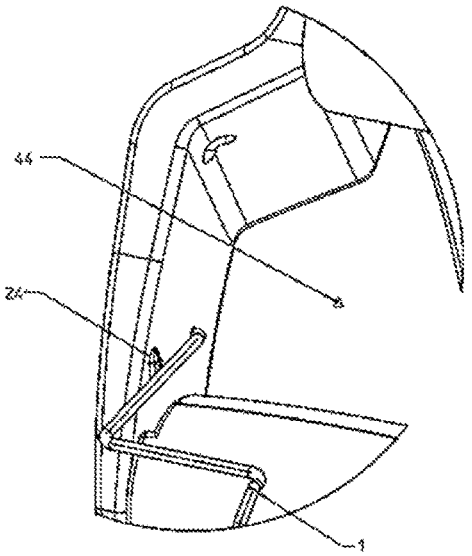
FIG. 10*b* illustrates a close up view of the tape gun with the tape end guide in an open position.

In order provide access to the tape end when threading through the gap, the present invention provides a means to delatch the end tape guide 1 from the closed position shown in FIG. 10*a* to a fully open position shown in FIG. 10*b* using the tape guide detent feature 24. This allows ample access to grab the end of the tape to extend it through the opening, and then position it onto the face of the platen 6 and in turn, cut off the excess with the blade 8, putting the tape in the required position to initiate a tape dispensing action.

Another aspect of the design induces a preload to the tape end guide 1 allowing it to snap back into place in the closed position. Due to the specific geometry at the ends 54 of the tape guide 1 shape where they install into the tape gun frame, the tape guide 1 will urge itself towards the closed position show in FIG. 10*a* to the point of only needing a last, gentle push force to engage it fully into the closed position tape guide detent feature 24. This is particularly useful as the user will be using one hand to manipulate the tape through the opening, and the other hand to hold the tape gun secure. With this gentle urging assist, the user is able to use the same securing hand to move the guide 1 back into the closed position shown in FIG. 10*a* with the flick of a finger.

Another aspect of this limitation is that due to the thin diameter of the guide 1, the tape is much less likely to stick to it compared to the wider, longer, and larger surface area of the traditional guide tabs of other tape guns. Due to the static electricity that is generated during use of the tape gun, the tape has the tendency to curl back on itself, and/or anything that is in close proximity. Therefore, it is very common for the tape to get caught up in the mechanisms and components of the tape gun making it quite frustrating to unravel, unstick, untangle the tape from the tape gun. This feature makes the tape less likely to wander, bunch or drift out of the preferred position for optimum function, making the taping operation more efficient between maintenance and function cycles.

Figure 6:
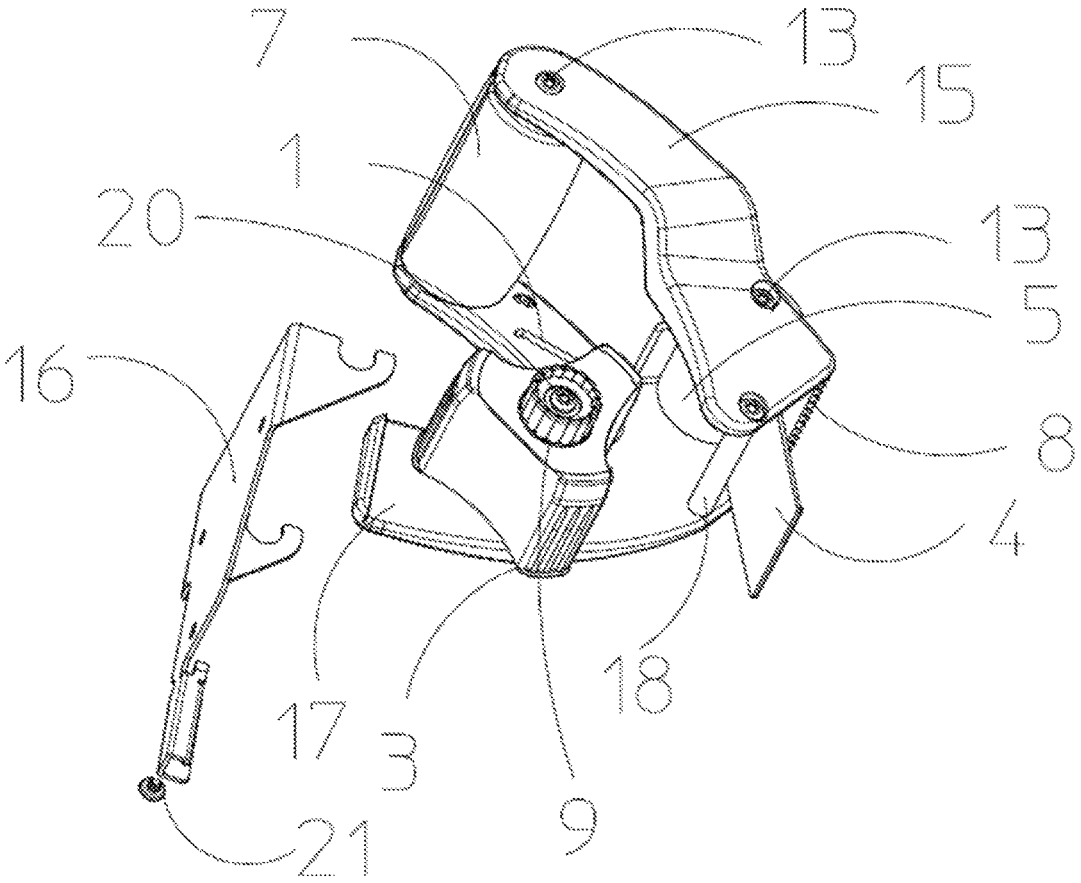
FIG. 6 is a perspective expanded view of the present invention in use with a wall bracket.
Figure 7:
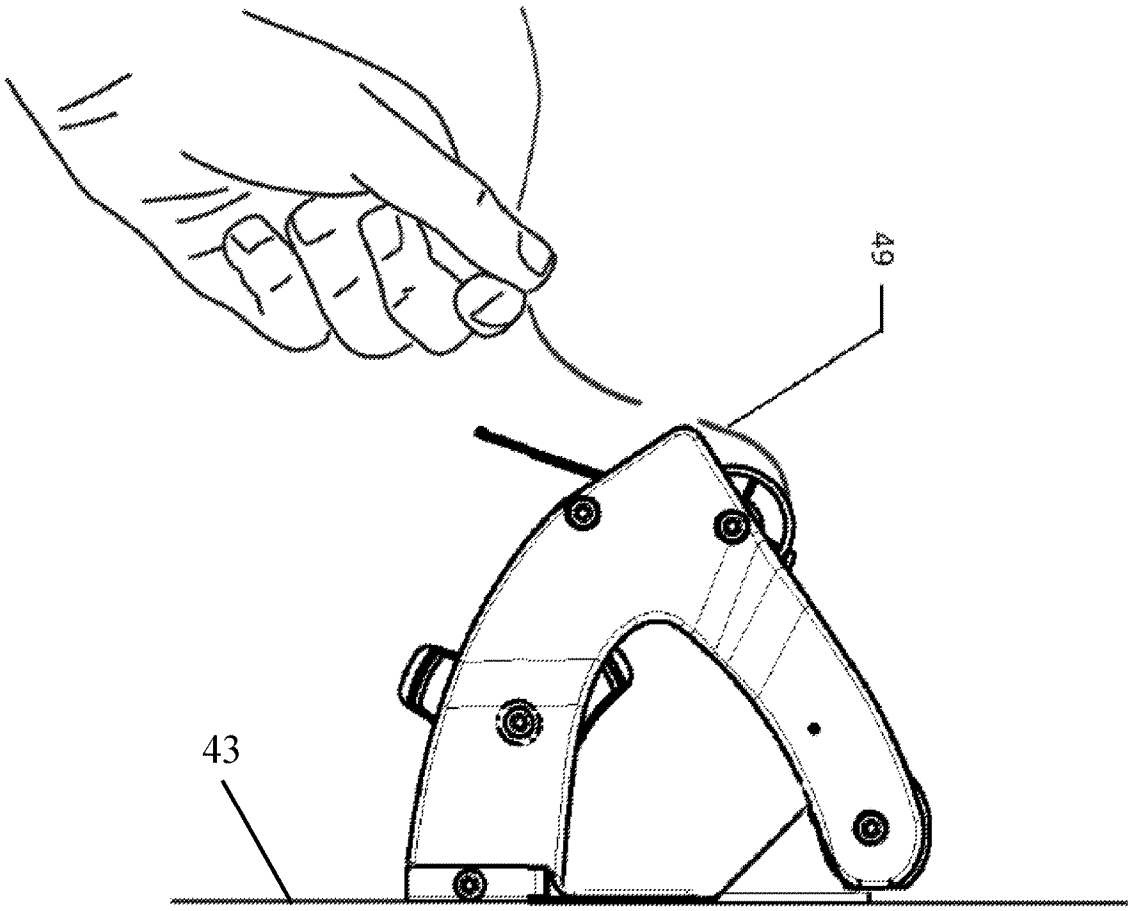
FIG. 7 illustrates the present invention in use when secured to a wall by a mounting bracket in an alternative embodiment.
Figure 8:
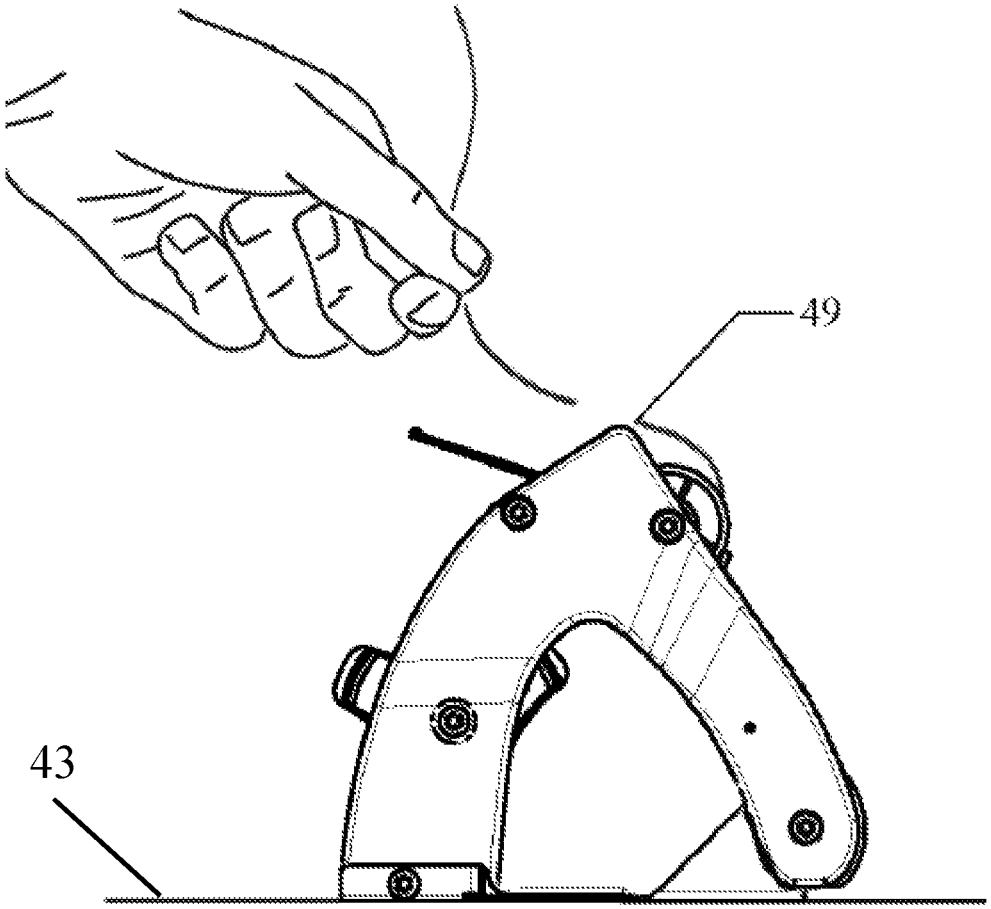
FIG. 8 illustrates the present invention when used on a table top as a fixed tape dispenser instead of a handheld tape dispenser.

In an alternative embodiment shown in FIG. 6, the device may be used in combination with a wall mounting bracket 16. In this embodiment, the wall mounting bracket is secured using screws or other means to a wall or table surface. Once mounted the wall bracket 16 removable retains the device to a wall or other flat surface by engaging the handle 7. In this position the device can simply be stored for future use, or the device can still dispense tape in the manner similar to a standard tape dispenser where a user simply pulls on tape and when the amount desired is reached, the user would simply pull the tape in a downward direction to apply pressure between the tape and blade, resulting in a dispensed section of tape.

The purpose of the wall mounting bracket 16 is multi-functional. The wall mounting bracket 16 provides a cradle to temporarily hang the tape gun vertically on a wall. The wall mounting bracket 16 provides a vertical mounting position to permanently mount the tape gun on a wall or other vertical surface. The wall mounting bracket 16 provides a cradle to temporarily secure the tape gun horizontally on a tabletop. The wall mounting bracket 16 provides a horizontal mounting position to permanently mount the tape gun on a tabletop or other horizontal surface.

Figure 11:
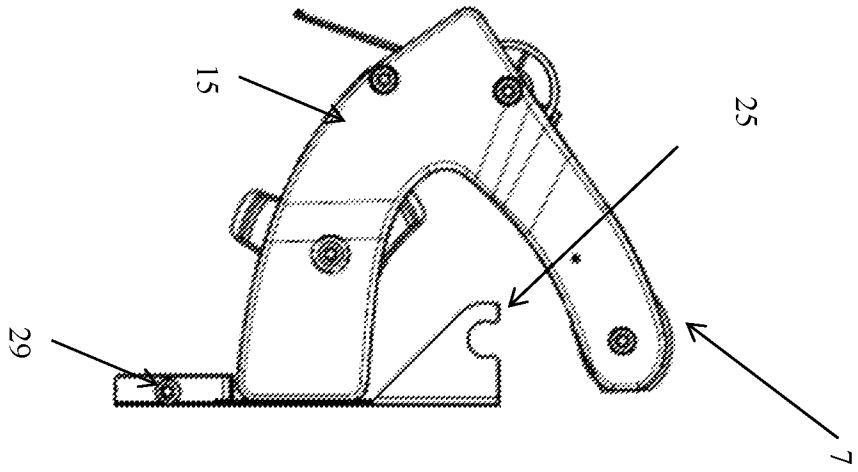
FIG. 11 is an Isometric view of the present invention in use with a wall bracket, where the wall bracket is mounted to a wall.
Figure 12:
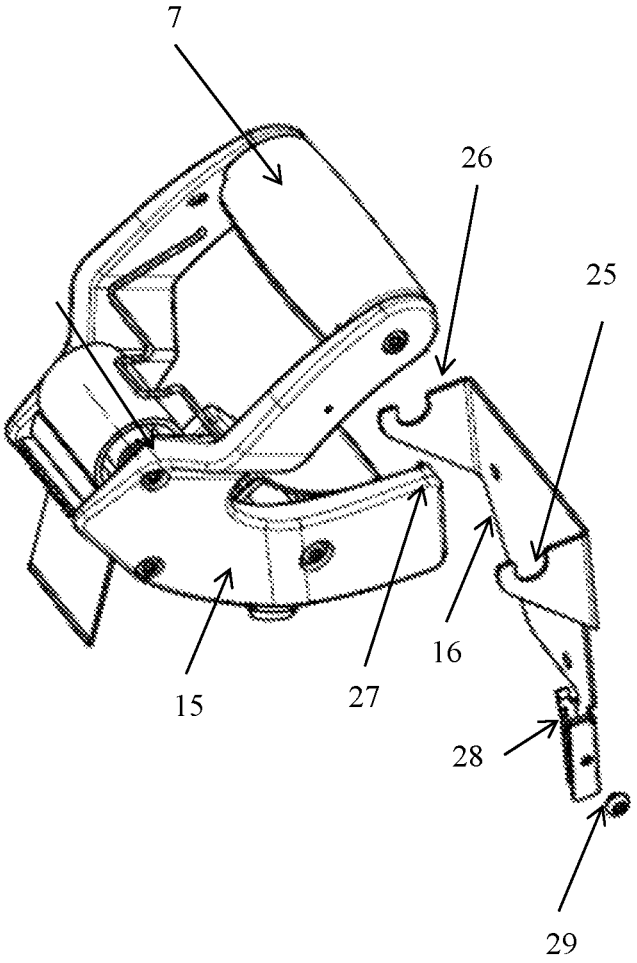
FIG. 12 is a perspective view of the present invention in use with a wall bracket.

In one embodiment, as shown in FIGS. 11 and 12, is by the use of a sheet metal, formed bracket 16 that includes hook features 25 to capture both ends of the tape gun handle 7. The other end hooks into the support arm 15 of the tape gun which includes an elongated L-shaped protrusion 27 running the length of the support arm 15. This allows a positive locking geometry in a parallel orientation when the tape gun is slid into place. This motion engages the hooks 25 on the handle 7 at the same time as engaging the L-shaped channel 28 into the elongated L-shaped protrusion 27 of the support arm 15.

The feature that makes this action either temporary or permanent is the screw 29 mounted midway along the length of the L-shaped channel 28. This screw can be a variety of fastener styles from a quick access thumbscrew, to a common drive style machine screw, to a specialized security drive head style fastener designed to deter someone from removing the tape gun from a permanently mounted location.

With the additional bracket, the tape gun can be either hard mounted to a horizontal or vertical surface—providing a rigid and secure structure. With the same mounting device, the tape gun can be clipped in and out of the bracket without the use of additional fasteners or clamping means for convenient, temporary cradle style mounting.

Therefore the present invention reduces manual strain due to improved placement of grip, distribution of centers of gravity, orientation of grip in relation to the cut-off device. Also, the present invention provides a stable means for using the device as a table top dispenser by creating a three point plane on which the product rests on a flat surface and does not shift due to forces applied while dispensing and cutting off lengths of tape.

In another embodiment, the specific component placement that defines a base structure for the dispenser to sit solidly on top of a flat, horizontal surface providing a secondary means to manually dispense lengths of tape. The generally V-shaped main body 17 and arm 15 enable the device to be placed on a table top surface in a stable position where the handle 7 and main body 17 end act as a support holding the device upright and the spool off the table surface so that tape can still be dispensed. In this position the device can simply be stored for future use, or the device can still dispense tape in the manner similar to a standard tape dispenser where a user simply pulls on tape and when the amount desired is reached, the user would simply pull the tape in a downward direction to apply pressure between the tape and blade, resulting in a dispensed section of tape.

The blade is comprised of metal, plastic, ceramic, or any other suitable material known in the art or combination thereof. The present invention is not limited to dispensing packaging tape, but can be used for a variety of roll tape materials.

Now referring to FIGS. 14-21, a burnisher/tape end guide to cover the sharp blade edge, preventing accidental cuts and scrapes which are common among users is shown. It is known in the industry that scrapes and cuts are a figurative badge of honor among users who are heavy users of conventional tape dispensers. This feature greatly reduces exposure to the blade and therefore reducing injury due to sharp blade exposure.

The burnisher/tape end guide is used to catch and retain the loose cut end of the tape. As part of the cutting action, the loose tape end is caught and retained snugly against the tape dispenser, and secured in position for the next application of tape. The condition of wrestling with the loose end of tape during use is the most common complaint of users. The very sticky surface of the tape and the propensity of the tape to flail around in unpredictable directions and eventually stick to unintended surfaces, or worse, getting tangle up in the tape dispenser requiring extensive clean up creates a very frustrating experience for users.

Commonly the tape is applied using two hands to manipulate the tape gun and the loose tape end. Consequently, the user will improvise by using other parts of the body (knees, torso, leg, etc.) to manipulate the workpiece for proper alignment and taping. This further increases the frustration for the user, and for the heavy user can cause repetitive motion injuries. This new feature eliminates the use of the free hand for the loose tape end, which would otherwise be used to keep the workpiece e.g, cardboard box) in proper alignment for applying the tape. The new feature of this invention allows the tape end to be more efficiently secured and maintained in position before and after a taping and cutting operation.

The burnisher/tape end guide is used to create a space between the tape dispenser and the resting surface, Most tape dispensers are set on their sides when not being used. Due to the pistol grip orientation of the handle (requiring the resting orientation), and the loose tape condition, the tape can easily adhere to the resting surface and/or nearby items.

The new features of this improved invention allow the tape dispenser to be place in a convenient and natural orientation where the Handle (7) and the main body (17) raise the mid-section of the tape dispenser above the resting surface (43). In combination with the burnisher and tape end guide (42), the tape is securely separated from the resting surface (43) as well as being securely retained in the tape dispenser without the annoyance of the loose tape end.

The burnisher and tape end guide (42) also functions as the burnisher. The rotating feature of this component provides this function without the need for an additional part.

Separating the original the left arm (15) with the roller plate (40) and support beam body (53) allows an unrestricted channel (44) for installing the tape between the roller (5) and a fixed guide, tape end (45). This replaces the Guide, Tape End (1) in the original application, and removes the need for a moving, rotating part. This provides more convenience for installing a new roll of tape as it reduces the number of items that the user needs to manipulate.

Currently for most tape dispensers, the user is required to perform a relatively skilled manipulation of the tape end, tape gun handle, and tape end guide in order to install the tape for the first time. Since there are three items needing manipulation, and only two hands available, the user is required to skillfully use some fingers and palm to grasp the handle, while using another finger to rotate the tape end guide out of the way of the channel while threading the loose tape end into the channel between the roller and tape end guide. This is another operation that users commonly complain about. This feature makes that operation easier to perform as it only requires one hand on the tape end and the other hand to hold the tape dispenser.

Figure 14:
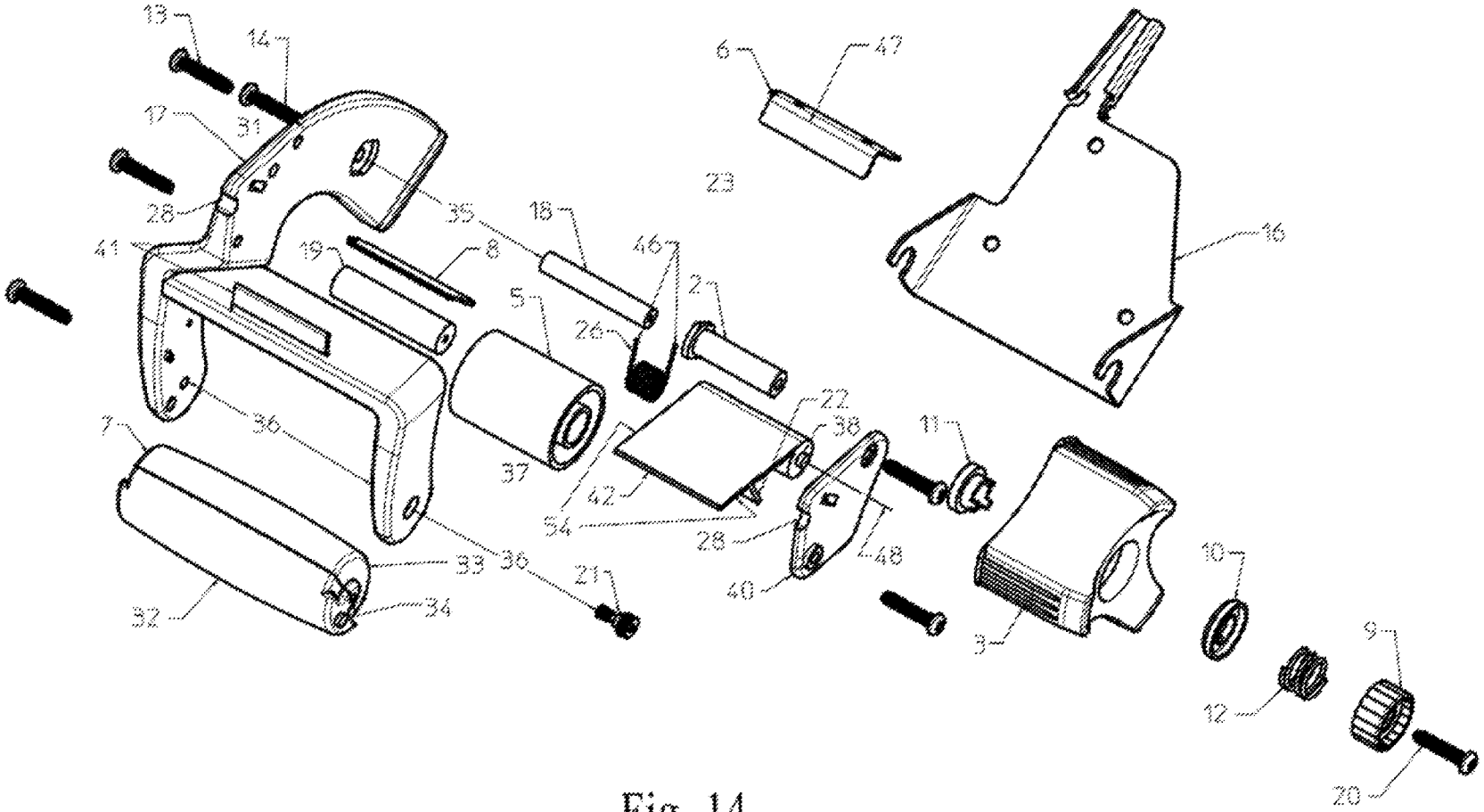
FIGS. 14-15 are expanded views of an alternative embodiment of the device of the present invention illustrating where a burnisher and tape end guide replaces the Burnisher of the first embodiment.
Figure 15:
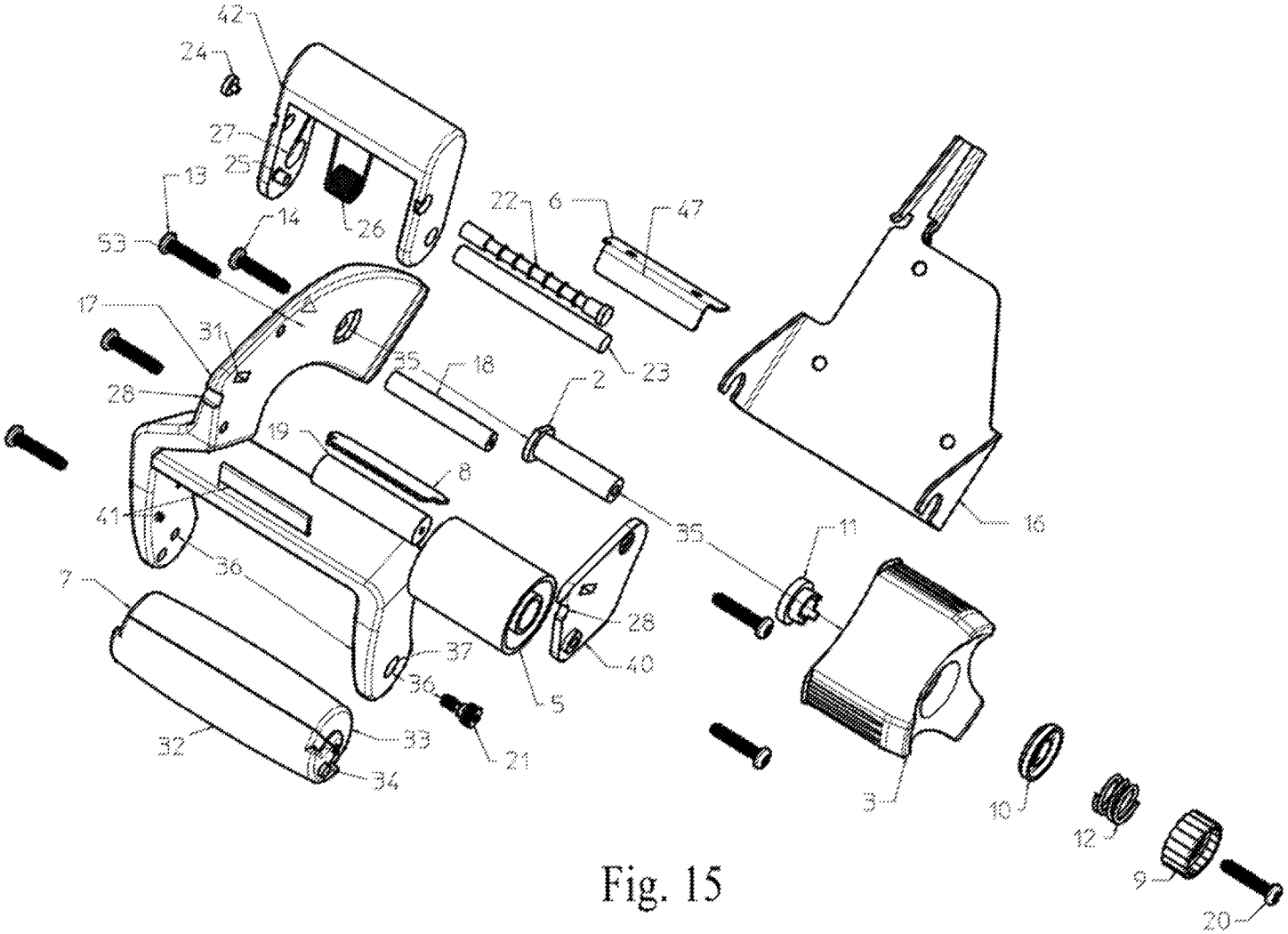

As shown in FIG. 14, a burnisher and tape end guide (42) replaces the Burnisher (42) of the original disclosure. The added functionality provides several improvements over the original component. The burnisher and tape end guide (42) serves as a guard that covers the sharp teeth of the device when in the closed position.

Figure 16:
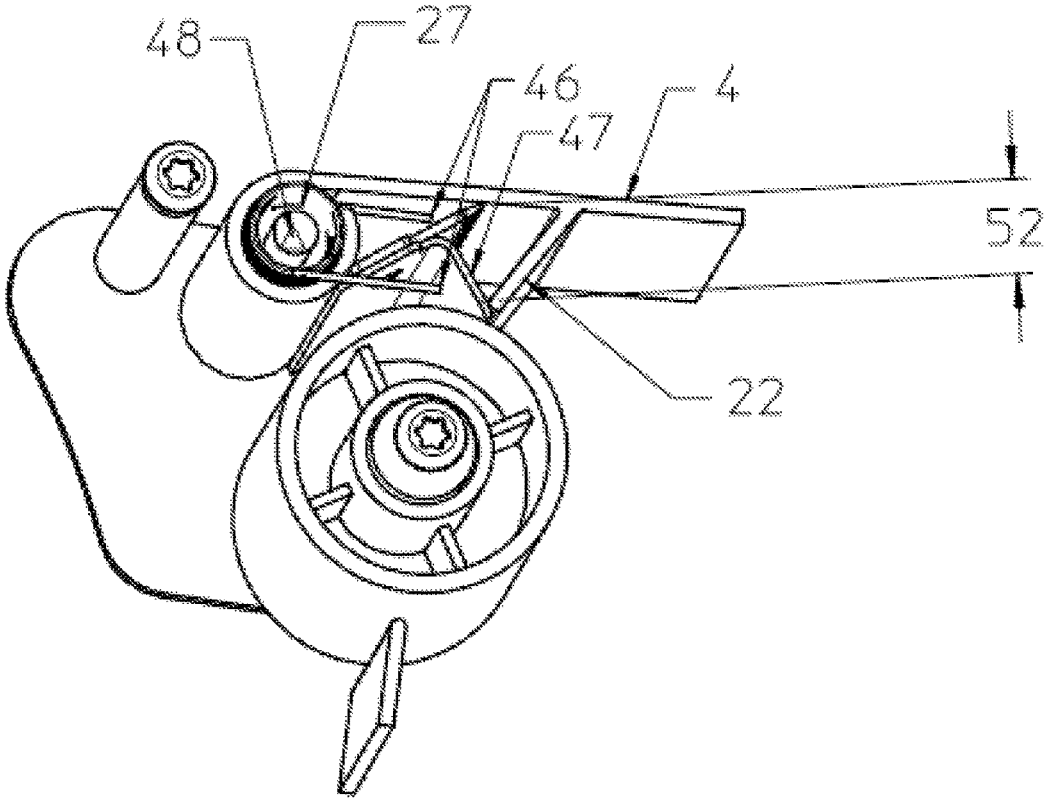
FIG. 16 illustrates where there is a torsion spring shown as return spring, tape end guide which is installed around a recessed shown as spring recess as part of the Burnisher/tape end guide.

Also, as shown in FIG. 16, the burnisher and tape end guide (42) is maintained in the closed position by the combination of feature working together to contain the part between the main body (17) and the roller plate (15). Additionally, there is a torsion spring (26) shown as return spring, tape end guide (42) which is installed around a recessed shown as spring recess (27) as part of the burnisher and tape end guide (42). The legs (46) of the return spring, tape end guide (42) are oriented between the spring recess (27) and the main body (17) such that there is ample pre-load on the spring in the closed position to ensure that the burnisher and tape end guide (42) is held firmly in the dosed position.

Figure 17:
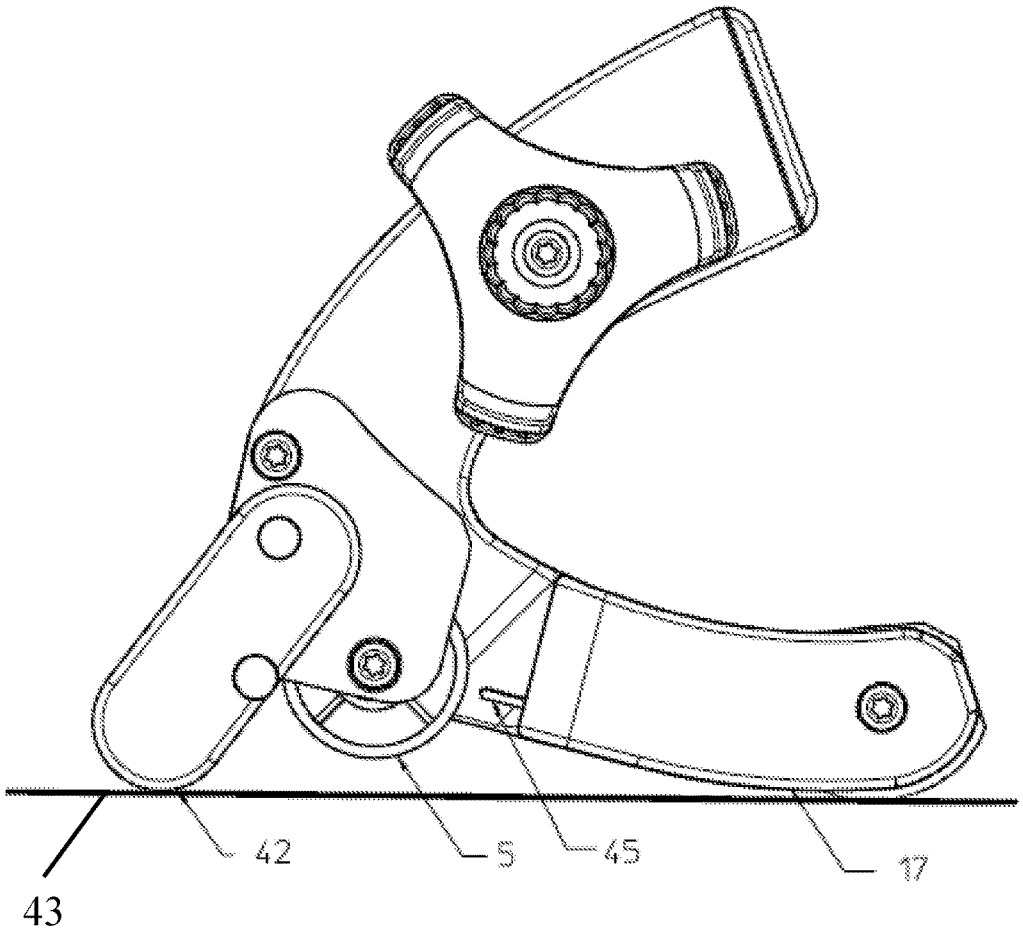
FIGS. 17, 18, and 19 illustrate the sequence where the burnisher and tape end guide rotates around the formed-in axis and counter-bored hole which allows the burnisher and tape end guide to be in the optimum position to perform a burnishing motion against the tape in the correct position for the blade to cut through the width of the tape.

Secondly, as the burnisher and tape end guide (42) is held in the closed position it provides a support surface in the orientation as shown in FIG. 17. This position allows space between the resting surface (43) and the roller (5) which, in combination with the tape end catch (22) and the contact surface (47) of the main body (17) ensures that the adhesive tape does not stick to the resting surface (43).

Figure 18:
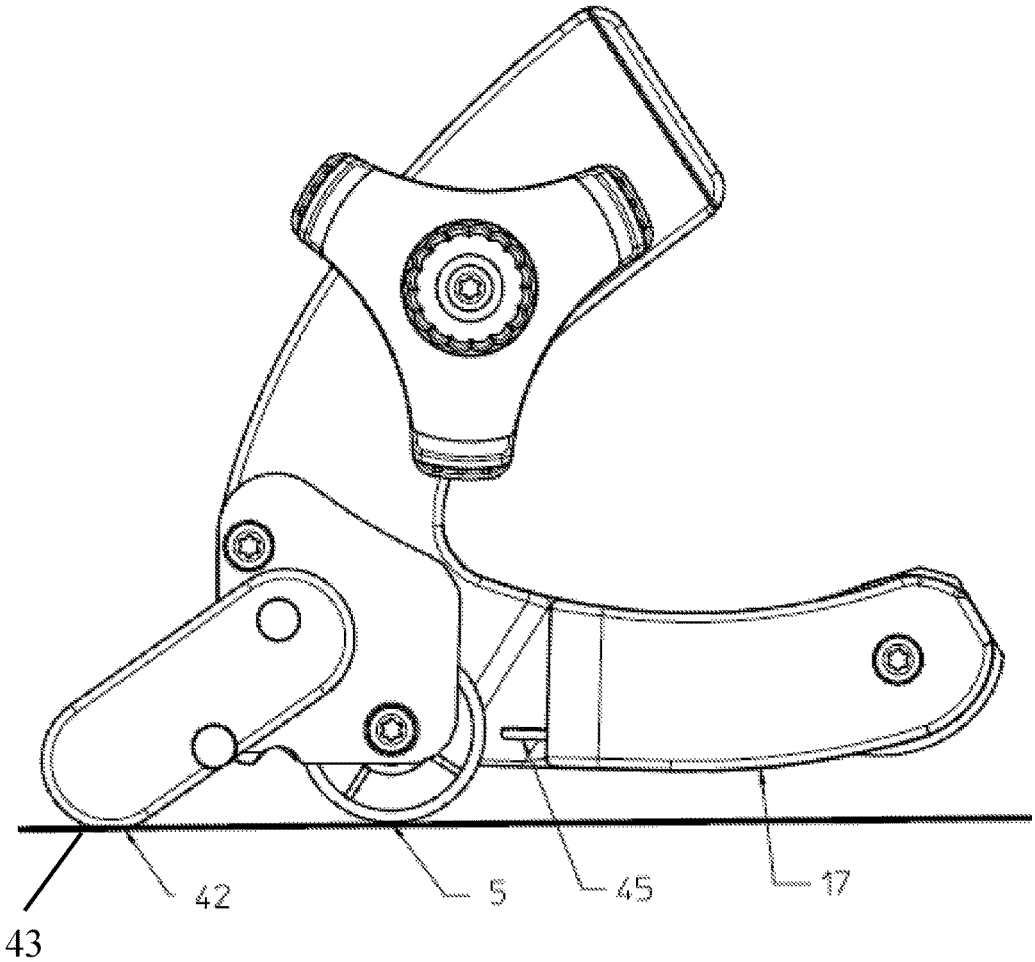
Figure 19:
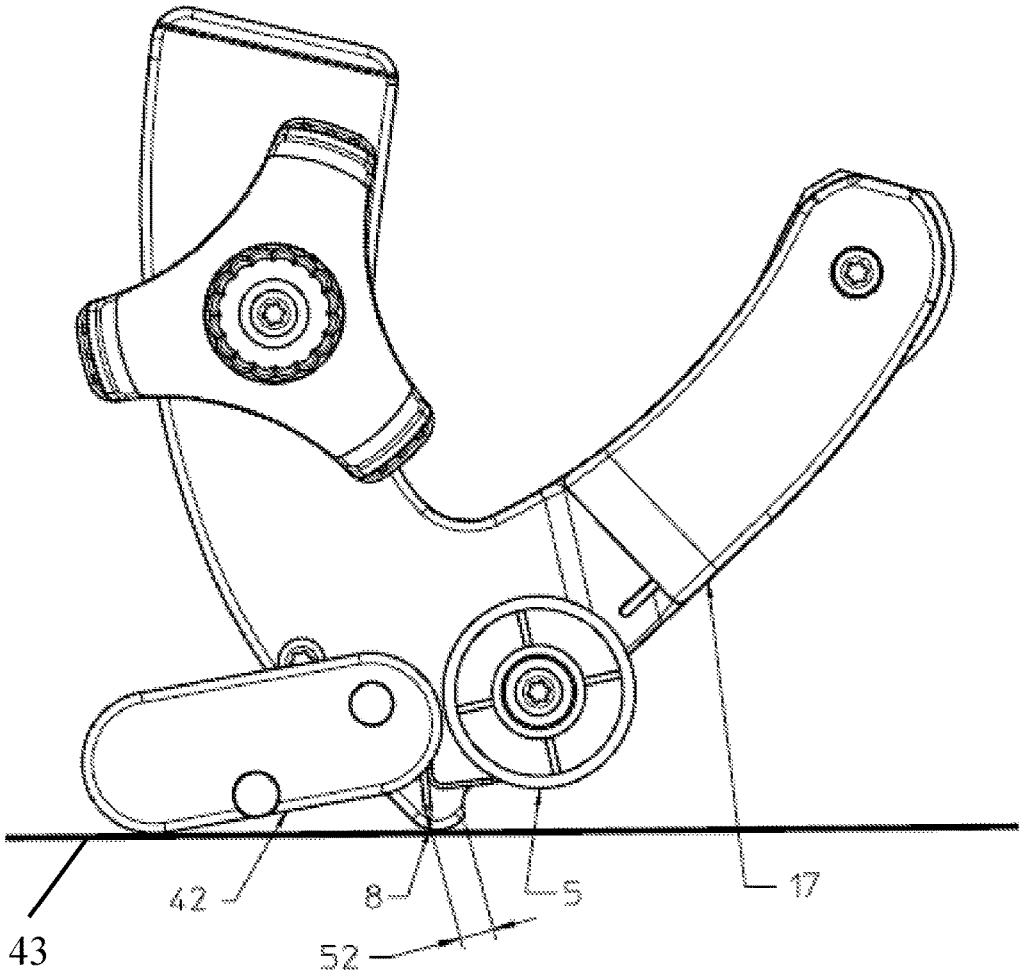
Figure 20:
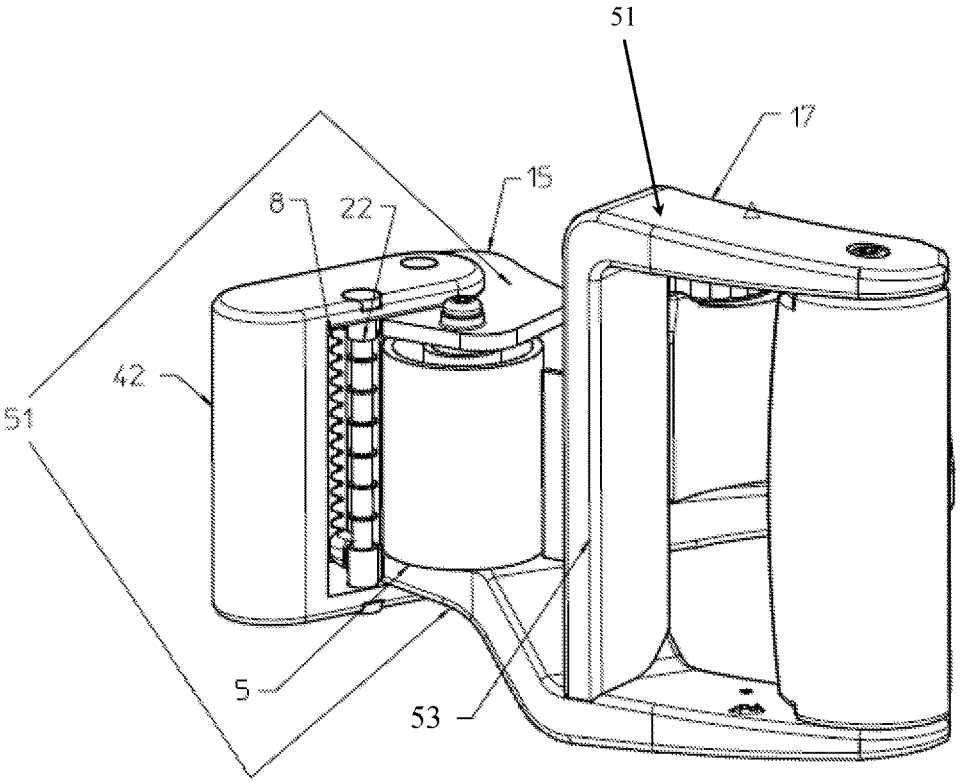
FIG. 20 illustrates where the tape end catch works in combination with the Burnisherltape end guide, return spring, tape end guide, and formed-in axis counter-bored hole to capture the loose end of the tape once the blade cuts through the width of the tape.
Figure 21:
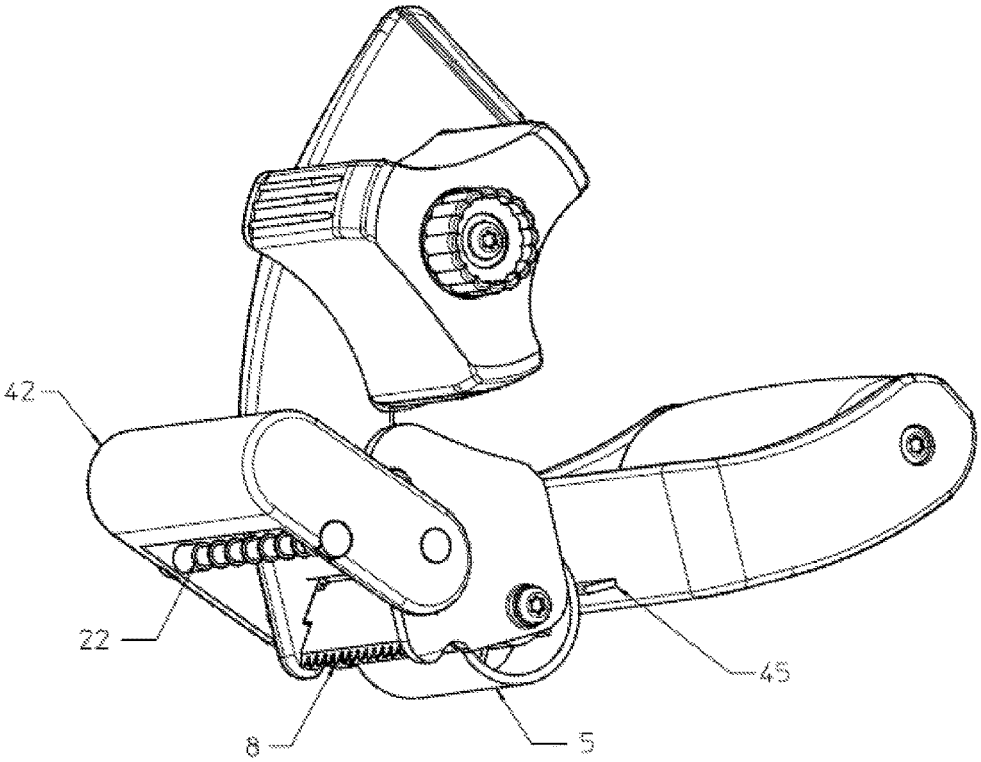
FIGS. 21, 22, and 23 illustrate the sequence where the burnisher and tape end guide rotates around the formed-in axis and counter-bored hole which allows the burnisher and tape end guide to be in the optimum position to perform a burnishing motion against the tape in the correct position for the blade to cut through the width of the tape.
Figure 22:
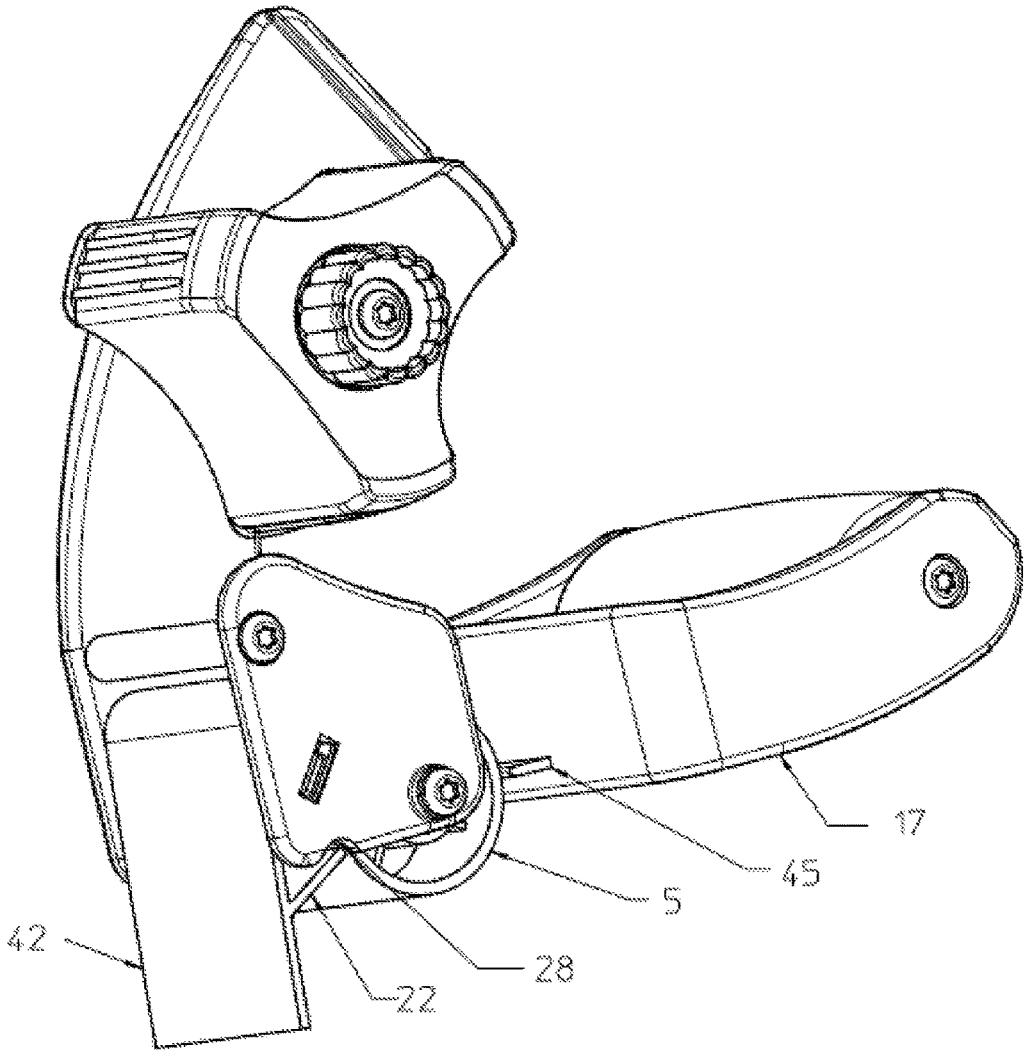
Figure 23:
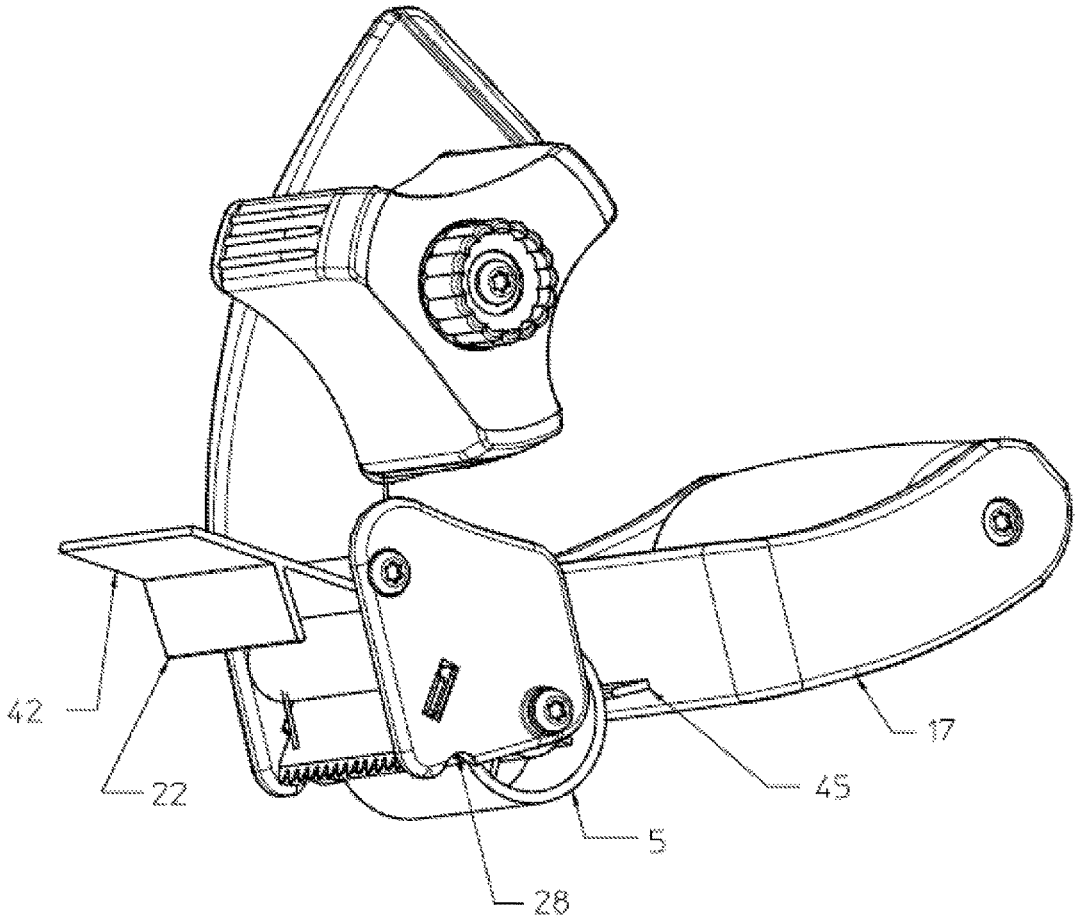

Thirdly, as shown in the sequence from FIGS. 17, 18, and 19, the burnisher and tape end guide (42) rotates around the formed-in axis (48) via a protrusion (38) that engages a counter-bored hole (39), which allows the burnisher and tape end guide (42) to be in the optimum position to perform a burnishing motion against the tape in the correct position for the blade (8) to cut through the width (50) of the tape. The burnishing operation ensures that the tape end which is applied to the workpiece is adhered with compression force as recommended by tape manufacturers.

Fourthly, the tape end catch (22) works in combination with the burnisher and tape end guide (42), return spring, tape end guide (42), and formed-in axis (48), counter-bored hole (39) to capture the loose end (49) of the tape once the blade (8) cuts through the width (50) of the tape. This greatly reduces the common condition of the loose tape end from sticking to various parts of the tape dispenser and its components, or sticking to nearby objects.

In one embodiment of these features, the burnisher and tape end guide (42) is configured to extend along the outer surfaces (51) of the main body (17) and the roller plate (15). Where as in another embodiment, the burnisher and tape end guide is configured to extend along the inner surfaces of the main body (17) and the roller plate (15). For the first embodiment, the notch, tape end guide (28) shown in two places on both the main body (7), and the roller plate (40) allow proper clearance (52) for the tape end catch (22) to rest in position just beneath the blade (8) which is the ideal location to catch and retain the loose tape end.

It will also be noted that the roller plate (40) replaces the left arm (15) of the original application. The purpose of separating the left arm (15) into two parts is so that when the tape is wound into the tape dispenser, it has an open channel between the fixed tape end guide (41) and the roller (5). This also eliminates the need for the Guide, Tape End (1) to rotate as detailed in the original application.

Further describing, in addition to the function described in item 3, separating the roller plate (40) and support beam body (53) into two parts is the design feature which allows the unrestricted channel (44) to be formed.

Thus, it is appreciated that the optimum dimensional relationships for the parts of the invention, to include variation in size, materials, shape, form, function, and manner of operation, assembly and use, are deemed readily apparent and obvious to one of ordinary skill in the art, and all equivalent relationships to those illustrated in the drawings and described in the above description are intended to be encompassed by the present invention.

Furthermore, other areas of art may benefit from this method and adjustments to the design are anticipated. Thus, the scope of the invention should be determined by the appended claims and their legal equivalents, rather than by the examples given.

The invention claimed is:

1. A tape dispensing device consisting of:

a generally V-shaped main body;

an arm;

the generally V-shaped main body and arm are attached to a plurality of interior components removeably affixed between the generally V-shaped main body and arm by a plurality of screws;

the interior components are a stem, a small support, a large support, a roller, a handle, a burnisher and tape end guide;

a tape spool;

a cut off device;

a blade;

a platen; and the handle has an axis that is parallel with a tape spool axis.

2. The device of claim 1, wherein the tape is securely separated from a resting surface by being securely retained in the tape dispenser.

3. The device of claim 1, wherein separating an original left arm with a roller plate and support beam body allows an unrestricted channel for installing the tape between the roller and a fixed guide, tape end.

4. The device of claim 1, wherein the burnisher and tape end guide serve as a guard that covers a plurality of sharp teeth of the device when in a closed position.

5. The device of claim 1, wherein the burnisher and tape end guide are maintained in a closed position by a combination of features working together to contain a part between the main body and the roller plate.

6. The device of claim 1, further comprising a torsion spring extends around a recessed as part of the burnisher and tape end guide;

two legs of a return spring, tape end guide are oriented between a torsion spring recess and the main body such that there is ample pre-load on a spring in a closed position to ensure that the burnisher and tape end guide are held firmly in the closed position.

7. The device of claim 1, wherein the burnisher and tape end guide are held in the closed position providing a support surface which allows space between a resting surface and the roller which, in combination with a tape end catch and a contact surface of the main body ensures that an adhesive tape does not stick to the resting surface.

8. The device of claim 7, wherein the tape end catch works in combination with the burnisher and tape end guide, a return spring, tape end guide, and a formed-in axis, and a counter-bored hole to capture a loose end of the tape once the blade cuts through a width of the tape.

9. The device of claim 1, wherein the burnisher and tape end guide rotate around a formed-in axis and a counter-bored hole which allows the burnisher and tape end guide to be in position for the blade to cut through a width of the tape.

10. The device of claim 9, wherein a tape end is applied to the workpiece is adhered with a compression force.

11. The device of claim 1, wherein the burnisher and tape end guide are configured to extend along an outer surface of the main body and a roller plate.

12. The device of claim 11, wherein a notch, tape end guide, and the roller plate allow a clearance for a tape end catch to rest in position beneath the blade to catch and retain a loose tape end.

13. The device of claim 1, wherein the burnisher and tape end guide are configured to extend along an inner surface of the main body and a roller plate.

14. The device of claim 1, wherein separating a left arm support beam body and a roller plate into two parts creates an open channel between the fixed tape end guide and the roller when the tape is wound into the tape dispenser.

15. The device of claim 1, wherein each of the interior components are retained by screws except the tape end guide, which is retained by tension forces between the main body and arm; and corresponding holes or slots are located on the main body and arm which retain an end of the tape end guide between the holes or slots using tension forces.

16. The device of claim 1, wherein the generally V-shaped main body and arm are secured to each other by the interior components when the interior components are attached to the main body and arm using one or more screws to removable attach an opposing end of the interior components;

a cushioned sleeve is around the handle;

the roller fits over the large support;

the screws secure each end of the large support to the main body; and a tension knob screw secures a tension knob to the main body.

17. The device of claim 1, wherein the blade is retained between the main body and arm;

both the main body and arm are comprised of relief notches to retain the blade;

the relief notches are rectangular so as to secure the blade in a fixed position with respect to the tape as the tape is dispensed from a roll on the spool between the platen and the roller.

18. The device of claim 1, wherein the handle is round or ellipsoid in shape.

* * * * *